US009625165B2

(12) United States Patent
Minamisako et al.

(10) Patent No.: US 9,625,165 B2
(45) Date of Patent: Apr. 18, 2017

(54) HOT WATER APPARATUS AND FAILURE NOTIFICATION METHOD FOR HOT WATER APPARATUS

(71) Applicant: Mitsubishi Electric Corporation, Tokyo (JP)

(72) Inventors: Hirokazu Minamisako, Tokyo (JP); Kei Takeyama, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 67 days.

(21) Appl. No.: 14/662,278

(22) Filed: Mar. 19, 2015

(65) Prior Publication Data

US 2016/0003486 A1 Jan. 7, 2016

(30) Foreign Application Priority Data

Jul. 7, 2014 (JP) ..... 2014-139363

(51) Int. Cl.
*F22B 37/42* (2006.01)
*F24H 9/20* (2006.01)
(Continued)

(52) U.S. Cl.
CPC ..... *F24D 19/1051* (2013.01); *F24D 19/0092* (2013.01); *F24D 19/1039* (2013.01);
(Continued)

(58) Field of Classification Search
CPC . F25B 25/005; F24D 19/0092; B67D 1/0878; F22B 37/42; F24H 9/20
(Continued)

(56) References Cited

U.S. PATENT DOCUMENTS

2015/0144074 A1* 5/2015 Fujimoto ..... F28G 15/003 122/14.21
2016/0033171 A1* 2/2016 Mase ..... F24H 1/145 122/14.3

FOREIGN PATENT DOCUMENTS

EP 0 676 682 A2 10/1995
JP 06117646 A * 4/1994
(Continued)

OTHER PUBLICATIONS

Extended European Search Report issued on Dec. 4, 2015 in the corresponding EP application No. 15163562.0.
(Continued)

*Primary Examiner* — Gregory A Wilson
(74) *Attorney, Agent, or Firm* — Posz Law Group, PLC

(57) ABSTRACT

An indirect-heating hot water apparatus is designed to correctly detect clogging in a secondary water circuit at low costs. A hot water apparatus is provided with: a primary water circuit in which water heated by absorbing heat from a refrigerant at a heat exchanger circulates; a secondary water circuit connected to the primary water circuit via a heat exchanger, in which water circulates; and a tank connected to the secondary water circuit, in which the water circulating in the secondary water circuit is stored. The hot water apparatus detects the temperature of the water circulating in the primary water circuit and the temperature of the water stored in the tank. When the temperature of the water circulating in the primary water circuit is at or above a first threshold and the temperature of the water stored in the tank is at or below a second threshold, the hot water apparatus issues a notification indicating that the secondary water circuit is clogged.

12 Claims, 6 Drawing Sheets

(51) Int. Cl.

| | |
|---|---|
| ***F24D 19/10*** | (2006.01) |
| ***F24D 19/00*** | (2006.01) |
| ***F24H 4/04*** | (2006.01) |
| ***F24H 1/20*** | (2006.01) |
| ***G08B 21/18*** | (2006.01) |

(52) U.S. Cl.
CPC ..... *F24D 19/1066* (2013.01); *F24H 1/208* (2013.01); *F24H 4/04* (2013.01); *F24H 9/2007* (2013.01); *G08B 21/182* (2013.01)

(58) Field of Classification Search
USPC ..... 122/14.1, 504; 236/46 R
See application file for complete search history.

(56) References Cited

FOREIGN PATENT DOCUMENTS

| | | | | |
|---|---|---|---|---|
| JP | 2000065425 | A | * | 3/2000 |
| JP | 2004-116942 | A | | 4/2004 |
| JP | 2009-150609 | A | | 7/2009 |
| JP | 2010-065852 | A | | 3/2010 |
| JP | 2010-091181 | A | | 4/2010 |
| JP | 2010-133600 | A | | 6/2010 |
| JP | 2012-241947 | A | | 12/2012 |
| WO | 2012/046461 | A1 | | 4/2012 |

OTHER PUBLICATIONS

Japanese Office Action of Feb. 7, 2017 in the corresponding JP application No. 2014-139363. (English translation attached).

* cited by examiner

HOT WATER APPARATUS AND FAILURE NOTIFICATION METHOD FOR HOT WATER APPARATUS

CROSS-REFERENCE TO RELATED APPLICATIONS

This application is based on and claims the benefit of priority from Japanese Patent Application No. 2014-139363, filed in Japan on Jul. 7, 2014, the content of which is incorporated herein by reference in its entirety.

TECHNICAL FIELD

This invention relates to a technology to detect water circuit clogging in a hot water apparatus.

BACKGROUND ART

Hot water apparatuses include direct-heating hot water apparatuses and indirect-heating hot water apparatuses. Direct-heating hot water apparatuses are designed to heat water circulating in a water circuit by a heat source, and store the heated water circulating in the water circuit in a tank. Indirect-heating hot water apparatuses are designed to heat water circulating in a primary water circuit by a heat source, then heat water circulating in a secondary water circuit by the heated water circulating in the primary water circuit, and then store the heated water circulating in the secondary water circuit in a tank.

Some indirect-heating hot water apparatuses use a fluid circuit, instead of the primary water circuit, in which a fluid other than water, such as brine, circulates.

Patent Document 1 discloses a method for detecting water circuit clogging caused by scale formation of calcium carbonate or the like, in a direct-heating hot water apparatus.

Patent Document 1 discloses the following methods for clogging detection:

(1) measuring changes in the flow rate of water in a water circuit;
(2) measuring changes in the pressure of water in a water circuit;
(3) measuring changes in the output of a pump in a water circuit; and
(4) measuring changes in heating capability.

CITATION LIST

Patent Literature

Patent Document 1: JP 2004-116942 A

SUMMARY OF INVENTION

Technical Problem

Method (1) requires a flow-rate measuring device, such as a flow switch or a flow sensor, to measure the flow rate of water. Method (2) requires a pressure measuring device, such as a pressure switch or a pressure sensor, to measure water pressure. Accordingly, employing method (1) or method (2) would end up increasing the cost of the hot water apparatus.

Referring further to method (2), although there is no clogging, clogging may be detected erroneously as water pressure is increased in a water circuit where water is heated and expands. To avoid the false detection, if the detection threshold is set loosely, then the detection of clogging is delayed when it happens. Delayed clogging detection ends up wasting energy.

Method (3) indicates indirect detection of pressure changes of a water circuit based on changes in pump outputs. Therefore, like method (2), clogging may be detected erroneously. Furthermore, if the detection threshold is set loosely in order to avoid the false detection, the detection of clogging is delayed when it happens.

Method (4) requires measuring the flow rate of water in order to measure heating capability. Therefore, like method (1), a flow-rate measuring device such as a flow switch or a flow sensor is required. Accordingly, employing method (4) would end up raising the cost of the hot water apparatus. Furthermore, heating capability is usually reduced when the temperature of water in the tank approaches a target water temperature or the like, for example. Therefore, when heating capability is reduced under such control, clogging may be detected erroneously although there is no clogging.

Any method (1) to (4) can be applied to clogging detection of the primary water circuit or the secondary water circuit in an indirect-heating hot water apparatus. However, there will be the same problems as those discussed above.

An objective of this invention is to correctly detect clogging in a secondary water circuit in an indirect-heating hot water apparatus at reduced costs.

Solution to Problem

A hot water apparatus according to this invention includes:

a fluid circuit in which a fluid heated by a heat source circulates:

a water circuit, connected to the fluid circuit via a heat exchanger, in which water circulates;

a tank, connected to the water circuit, in which the water absorbing heat from the fluid at the heat exchanger is stored;

a fluid temperature detector that detects a fluid temperature of the fluid circulating in the fluid circuit;

a tank temperature detector that detects a tank temperature of the water stored in the tank; and a notifier that issues a notification indicating that the water circuit is clogged, when the fluid temperature detected by the fluid temperature detector is at or above a first threshold and the tank temperature detected by the tank temperature detector is at or below a second threshold.

Advantageous Effects of Invention

According to a hot water apparatus of this invention, water circuit clogging is detected based on fluid temperatures and tank temperatures. Hot water apparatuses are usually provided with a temperature sensor to detect fluid temperatures and a temperature sensor to detect tank temperatures. Therefore, the hot water apparatus of this invention does not require an extra device to detect water circuit clogging, thereby saving additional costs in this regard. Furthermore, it is rare that the fluid temperature gets higher than expected while the tank temperature is low, except that there is clogging. Therefore, false detection is less likely to happen in the hot water apparatus of this invention.

BRIEF DESCRIPTION OF DRAWINGS

The present invention will become fully understood from the detailed description given hereinafter in conjunction with the accompanying drawings, in which.

DESCRIPTION OF EMBODIMENTS

Figure 1:
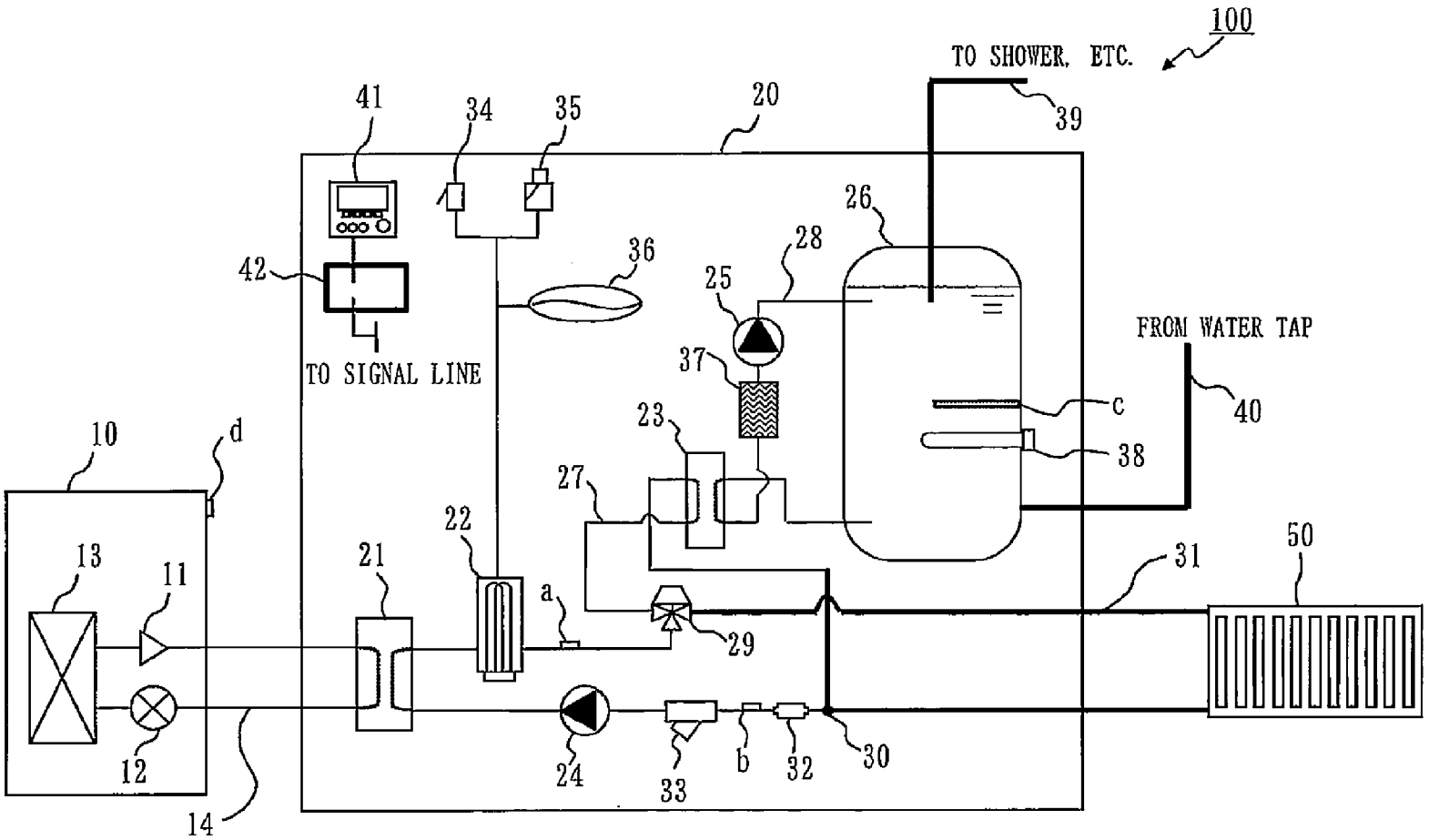
FIG. 1 illustrates a configuration of a hot water apparatus 100 according to a first embodiment.

In describing preferred embodiments illustrated in the drawings, specific terminology is employed for the sake of clarity. However, the disclosure of the present invention is not intended to be limited to the specific terminology so selected, and it is to be understood that each specific element includes all technical equivalents that operate in a similar manner and achieve a similar result.

Embodiment 1

FIG. 1 illustrates a hot water apparatus 100 according to a first embodiment.

The hot water apparatus 100 is provided with a heat pump 10 (an example of a heat source), a water heater 20 and a room heater 50.

The heat pump 10 is provided with a compressor 11, an expansion valve 12 and a heat exchanger 13.

The water heater 20 is provided with a heat exchanger 21, a heater 22, a heat exchanger 23, a pump 24, a pump 25, a tank 26 and the like.

The compressor 11, the heat exchanger 21, the expansion valve 12 and the heat exchanger 13 are sequentially connected via pipes to form a refrigerant circuit 14 in which a refrigerant circulates.

The heat exchanger 21, the heater 22, the heat exchanger 23 and the pump 24 are sequentially connected via pipes to form a primary water circuit 27 (an example of a fluid circuit) in which water circulates. The heat exchanger 23, the pump 25, the tank 26 are sequentially connected via pipes to form a secondary water circuit 28 (an example of a water circuit) in which water circulates.

In the primary water circuit 27, a three-way valve 29 is provided between the heater 22 and the heat exchanger 23. At the three-way valve 29, a room heating circuit 31 branches off from the primary water circuit 27 and rejoins the primary water circuit 27 at a junction 30 between the heat exchanger 23 and the pump 24. The room heater 50 is connected to the room heating circuit 31 along the way.

Between the junction 30 and the pump 24 in the primary water circuit 27, a flow sensor 32 to measure water flow rate and a strainer 33 to remove unwanted substances and the like flowing in the primary water circuit 27 are provided. The primary water circuit 27 is also provided with a pressure relief valve 34 for relieving pressure in the primary water circuit 27, an air purge valve 35 for removing air in the primary water circuit 27, and an expansion tank 36 for temporarily storing surplus water circulating in the primary water circuit 27 which are connected via a pipe that branches off from the primary water circuit 27 at the heater 22.

The secondary water circuit 28 is provided with a scale trap 37 to trap scale of calcium carbonate or the like, which is connected between the heat exchanger 23 and the pump 25.

The tank 26 is provided with a heater 38 for heating the water stored in the tank 26, a supply port 39 for supplying water to sanitary equipment such as a shower, and a feed-water inlet 40 for feeding water into the tank 26.

The hot water apparatus 100 is provided with temperature sensors a to d. The temperature sensor a is provided between the heater 22 and the heat exchanger 23 to detect an inflow temperature of water flowing into the heat exchanger 23. The temperature sensor b is provided between the heat exchanger 23 and the heat exchanger 21 to detect an outflow temperature of water flowing out of the heat exchanger 23. The temperature sensor c detects a tank temperature of the water stored in the tank 26. The temperature sensor d detects outside air temperature.

The position of the temperature sensor a is not limited to that illustrated in FIG. 1, and the temperature sensor a may be disposed anywhere between the heater 22 and the heat exchanger 23. Likewise, the position of the temperature sensor b is not limited to that illustrated in FIG. 1, and the temperature sensor b may be disposed anywhere between the heat exchanger 23 and the heat exchanger 21.

The water heater 20 is provided with an input/output device 41 which is provided for a user to set a target water temperature, a target room temperature, and the like. The target water temperature indicates a desired temperature of the water stored in the tank 26 to be heated. The target room temperature indicates a desired temperature of room air to be heated by the room heater 50.

The water heater 20 is also provided with a controller 42 which controls the compressor 11, the pump 24, the heater 22 and the like, to have appropriate heating capability, based on the tank temperature detected by the temperature sensor c, the outside air temperature detected by the temperature sensor d, the target water temperature and the target room temperature which are set by the input/output device 41, and the like. The controller 42 may be implemented by a microcomputer, for example.

Figure 2:
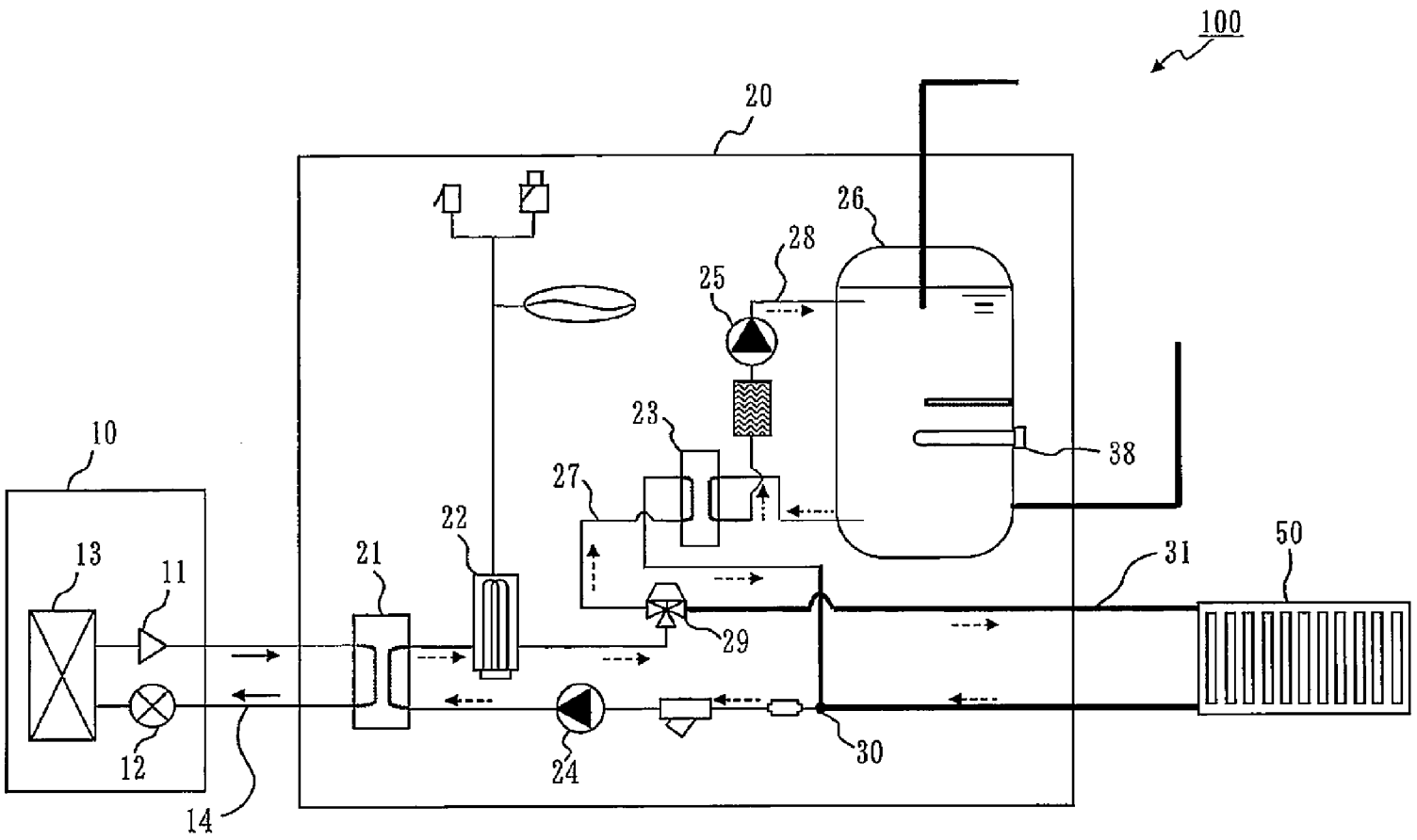
FIG. 2 illustrates flows of a refrigerant and water in the hot water apparatus 100 according to the first embodiment.

FIG. 2 illustrates flows of the refrigerant and water in the hot water apparatus 100 according to the first embodiment. Referring to FIG. 2, solid arrows indicate the flow of the refrigerant in the refrigerant circuit 14, dashed arrows indicate the flow of the water in the primary water circuit 27 and the room heating circuit 31, and dashed-dotted arrows indicate the flow of the water in the secondary water circuit 28.

Referring to the refrigerant circuit 14, the refrigerant turns into a high-temperature high-pressure refrigerant through the compressor 11, and flows into the heat exchanger 21. In the heat exchanger 21 where the heat of the refrigerant is exchanged with the heat of the water circulating in the primary water circuit 27, the refrigerant is condensed and turns into a liquid refrigerant, while the water circulating in the primary water circuit 27 is heated. The liquid refrigerant then expands through the expansion valve 12, and turns into a two-phase low-temperature low-pressure gas-liquid refrigerant. The two-phase gas-liquid refrigerant flows into the heat exchanger 13 where the heat of the refrigerant is exchanged with the heat of the outside air to vaporize, turning into a gas refrigerant. The gas refrigerant is then sucked in by the compressor 11 again to have a high temperature and a high pressure.

Referring to the primary water circuit 27, the heated water at the heat exchanger 21 flows into the heater 22. In the heater 22, the water is further heated when heating at the heat exchanger 21 is not sufficient. Water flowing out from the heater 22 flows into the heat exchanger 23 via the three-way valve 29, in water heating operation, and flows into the room heating circuit 31 via the three-way valve 29 and the room heater 50, in room heating operation.

In water heating operation, the water flowing into the heat exchanger 23 is cooled after the heat of the water is exchanged with the heat of the water circulating in the secondary water circuit 28, while the water circulating in the secondary water circuit 28 is heated. In room heating operation, the water flowing into the room heater 50 is cooled after the heat of the water is exchanged with the heat of air of the room in which the room heater 50 is installed, while the room air is heated.

The cooled water in the secondary water circuit 28 or the cooled water at the room heater 50 flows back to the heat exchanger 21 via the junction 30 and the pump 24.

In the above discussion, water heating operation and room heating operation are performed separately at a time. However, water heating operation and room heating operation can be performed at the same time. In this case, the water flowing out of the heater 22 is divided at the three-way valve 29 and flows into the heat exchanger 23 and the room heating circuit 31 to the room heater 50. Then, the water flowing into the heat exchanger 23 where the heat of the water is exchanged with the heat of the water circulating in the secondary water circuit 28, and the water flowing into the room heater 50 where the heat of the water is exchanged with the heat of the room air, merge at the junction 30, and flow back into the heat exchanger 21.

Referring to the secondary water circuit 28, heated water at the heat exchanger 23 flows into the tank 26 through the pump 25. The water stored in the tank 26 flows out at a lower portion of the tank 26 into the heat exchanger 23. When the temperature of the water stored in the tank 36 is insufficiently low, the water is heated supplementarily by the heater 38 under control of the controller 42.

As mentioned earlier, scale formation of calcium carbonate or the like arises in the primary water circuit 27, the secondary water circuit 28, and their elements because of water circulating therein. Such scale formation may cause clogging in the circuits to narrow the flow paths. Narrowed flow paths result in reducing the flow rate of circuit water, thereby reducing heating capability. If a plate heat exchanger is used as the heat exchanger 21, 23, part of the flow path in the heat exchanger 21, 23 may be clogged to reduce the area of heat exchange, thereby reducing heating capability. As a result, the heat pump 10 needs to be operated for a longer period of time than the time required when there is no clogging, in order to heat water up to the target water temperature in water heating operation.

The configuration illustrated in FIG. 1 shows that the primary water circuit 27 is provided with the flow sensor 32. Therefore, clogging can be detected by the method for measuring flow rate changes of water disclosed in Patent Document 1, or the like.

The secondary water circuit 28 is not provided with a flow sensor. If the secondary water circuit 28 is also provided with a flow sensor, then clogging could be detected. However, the provision of a flow sensor in the secondary water circuit 28 raises costs. Clogging can be detected without a flow sensor or the like, by applying the method for measuring output changes from the pump 25 as disclosed in Patent Document 1, However, clogging may be detected erroneously although there is no clogging, or the detection of clogging may be delayed when it happens.

The secondary water circuit 28 is provided with the scale trap 37. The scale trap 37 can trap scale soon after its formation, which prevents scale from developing. Thereby, the secondary water circuit 28 and its elements are not easily clogged. However, scale may deposit a lot on the scale trap 37 over time which may cause clogging in the flow path at the scale trap 37.

When a plate heat exchanger is used as the heat exchanger 23, the flow paths of the plate heat exchanger are so narrow that they may be clogged if the scale trap 37 is provided.

According to the hot water apparatus 100 of the first embodiment, the controller 42 detects clogged secondary water circuit 28 based on the temperature (fluid temperature) of the water circulating in the primary water circuit 27 and the temperature (tank temperature) of the water stored in the tank 26.

In the normal mode where the secondary water circuit 28 is not clogged, the amount of heat absorbed at the heat exchanger 21 by the water circulating in the primary water circuit 27 is transferred to the water circulating in the secondary water circuit 28 at the heat exchanger 23. The heat transfer from the water circulating in the primary water circuit 27 to the water circulating in the secondary water circuit 28 increases the temperature of the water in the tank 26, whereby the temperature of the water flowing into the tank 26 and the temperature of the water circulating in the primary water circuit 27 become close to each other.

However, when the secondary water circuit is clogged, the flow rate of the water circulating in the secondary water circuit 28 is reduced. Therefore, the amount of heat to be absorbed from the water circulating in the primary water circuit 27 by the water circulating in the secondary water circuit 28 at the heat exchanger 23 is reduced, which delays the rise in temperature of the water in the tank 26 greatly. On the other hand, heating capability at the heat exchanger 21 where the refrigerant heats the water circulating in the primary water circuit 27 remains unchanged. As a result, when the secondary water circuit 28 is clogged, the temperature of the water circulating in the primary water circuit 27 gradually increases while the temperature of the water in the tank 26 remains low. Based on this characteristic feature, the controller 42 detects clogging when the temperature of the water in the tank 26 is low despite a high temperature of the water circulating in the primary water circuit 27.

Figure 3:
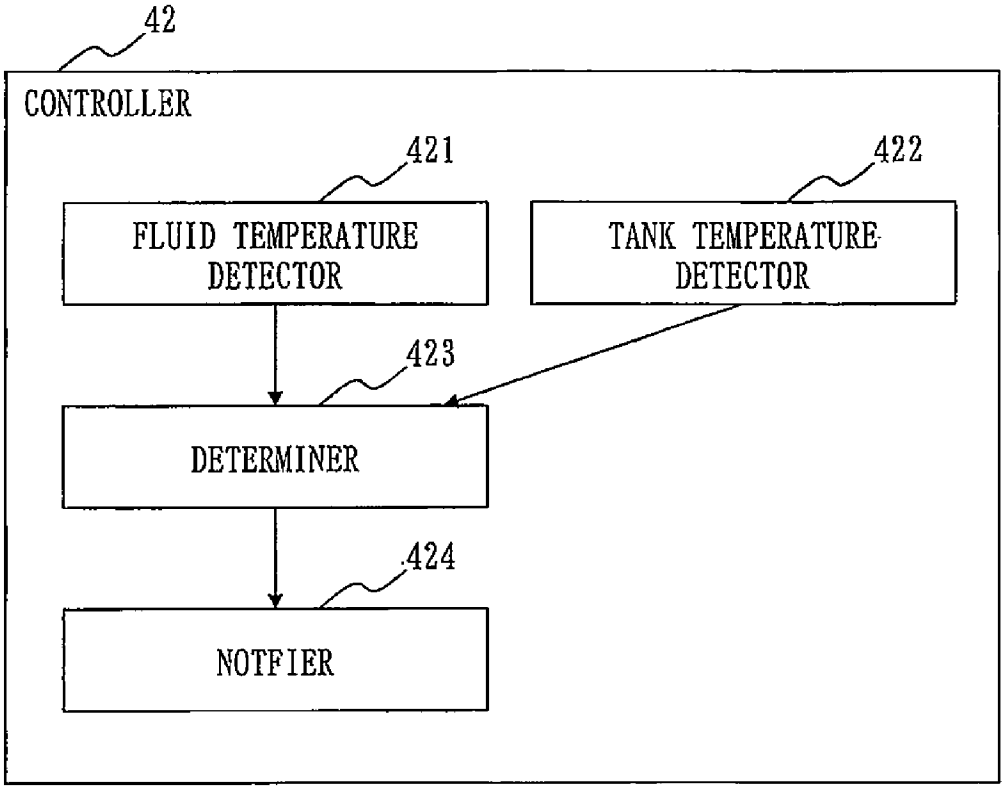
FIG. 3 illustrates a configuration of a controller 42 according to the first embodiment.

FIG. 3 illustrates a configuration of the controller 42 according to the first embodiment. FIG. 3 shows a configuration required for detecting clogging in the secondary water circuit 28 only, for simplicity, although the controller 42 is provided with functions to control the compressor 11 and the like, as described earlier. The controller 42 is provided with a fluid temperature detector 421, a tank temperature detector 422, a determiner 423 and a notifier 424.

Figure 4:
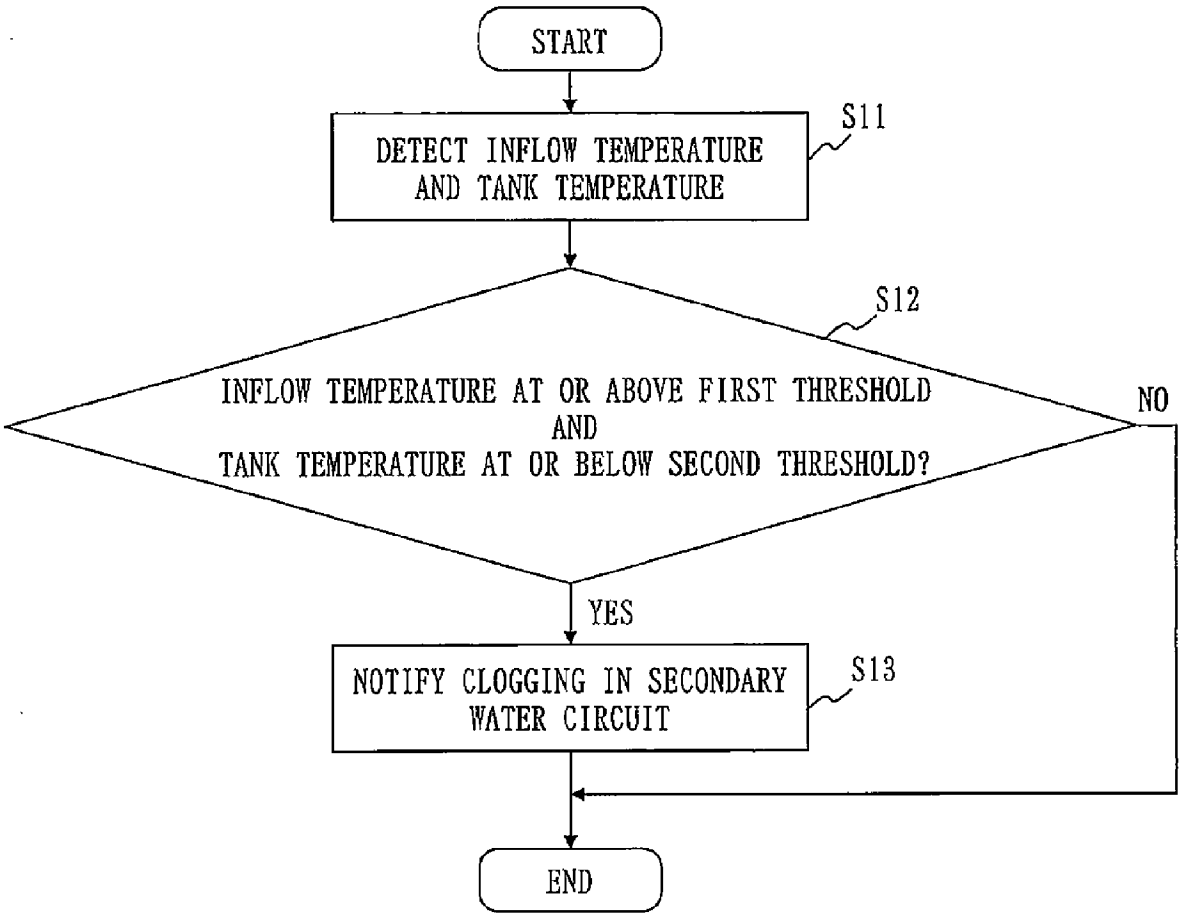
FIG. 4 is a flow chart illustrating a process of clogging detection in a secondary water circuit 28 according to the first embodiment.

FIG. 4 is a flow chart illustrating a process of detecting clogging in the secondary water circuit 28 according to the first embodiment.

(S11: Temperature Detecting Step)

The fluid temperature detector 421 detects the inflow temperature, using the temperature sensor a, as the temperature (fluid temperature) of the water circulating in the primary water circuit 27. The tank temperature detector 422 detects the tank temperature of the water stored in the tank, using the temperature sensor c.

(S12: Determining Step)

The determiner 423 determines whether or not the inflow temperature detected at S11 is at or above the first threshold and the tank temperature detected at S11 is at or below the second threshold.

When the determiner 423 determines that the inflow temperature is at or above the first threshold and the tank temperature is at or below the second threshold (YES at S12), the process moves on to S13, but otherwise (NO at S12) the process is terminated.

(S13: Notifying Step)

The notifier 424 notifies the user that the secondary water circuit 28 is clogged.

For example, the notifier 424 notifies clogging by displaying an error code or the like indicating the clogging, on the display of the input/output device 41. This is not the only way. The notifier 424 may, alternatively, notify of clogging by blinking a predetermined lamp provided in the hot water apparatus 100, or by outputting a predetermined sound via a speaker provided in the hot water apparatus 100. Alternatively, the notifier 424 may notify the user of clogging by sending an error code or the like to a personal computer (PC), a mobile terminal, or the like of the user via a network such as a wireless LAN (local area network).

When notified of clogging, the user can unclog the secondary water circuit 28 by changing the scale trap 37 or the heat exchanger 23, or the like. Unclogging can stop wasting energy.

The first threshold used in S12 is set in a memory or the like in the controller 42 before shipment from the factory, or the like, prior to the start of the process described in FIG. 4.

The appropriate value of the first threshold depends on various factors such as the performance of the heat pump 10, the performance of the heat exchanger 21, 23, and the like. The setting of the first threshold decides the frequency of false detection, the detectable degree of clogging, and the like. For this reason, the first threshold is set based on the result of a test of clogging deliberately caused in the secondary water circuit 28, for example.

The second threshold used in S12 is set in a memory or the like in the controller 42 before shipment from the factory, or the like, prior to the start of the process described in FIG. 4.

Like the first threshold, the appropriate value of the second threshold depends on various factors such as the performance of the heat pump 10, the performance of the heat exchanger 21, 23, and the like. The appropriate value of the second threshold also depends on the set value of the first threshold. For this reason, the second threshold is set at the same time as setting the first threshold, based on the result of the test of clogging deliberately caused in the secondary water circuit 28, for example.

The first threshold may be set to around 90° C. when the heater 22 is working, for example. When the heater 22 is not working, the first threshold may be set to around 55-65° C. depending on the performance of the heat pump 10, for example. The second threshold may be set to a temperature (e.g., around 20° C.) slightly above the temperature of water (tap water) supplied via the feed-water inlet 40, for example.

Thus, according to the first embodiment, the hot water apparatus 100 detects clogging in the secondary water circuit 28 based on the temperature of the water circulating in the primary water circuit 27 and the tank temperature. The hot water apparatus 100 is usually provided with the temperature sensor a to detect the temperature of the water circulating in the primary water circuit 27. The temperature sensor c to detect the tank temperature is also provided for deciding the start and end of an operation for storing hot water. Therefore, there is no need to add an extra device to detect clogging in the secondary water circuit 28, which can save additional costs in this regard. Furthermore, since the inflow temperature and the tank temperature are determined based on different thresholds, algorithms in the determiner 423 may be simplified.

In the previous discussion, the inflow temperature is used as the temperature of the water circulating in the primary water circuit 27. Alternatively, the outflow temperature detected by the temperature sensor b may be used instead, as the temperature of the water circulating in the primary water circuit 27. In this case, the fluid temperature detector 421 is to detect the outflow temperature, instead of the inflow temperature, at S11. Then, the determiner 423 is to determine whether or not the outflow temperature is at or above the first threshold and the tank temperature is at or below the second threshold, at S12.

Further, in the, previous description, water circulates in the first primary circuit 27. Alternatively, a fluid such as brine may circulate, instead of water, in the primary water circuit 27, for example.

Further, in the previous description, the heat pump 10 is used as the heat source. Instead of the heat pump 10, a boiler, an electric heater based on Joule heating, or the like may be used alternatively as the heat source.

Further, in the previous description, the temperature sensors a, b and c are used. Instead of the temperature sensors a, b and c, thermostats may be used alternatively.

Embodiment 2

A second embodiment is directed to a control when the secondary water circuit 28 is clogged.

In the second embodiment, the same features as those described in the first embodiment will not be discussed, and only the features that are different from those of the first embodiment will be elaborated.

Referring to the first embodiment, the user is notified that the secondary water circuit 28 is clogged when the inflow temperature is at or above the first threshold and the tank temperature is at or below the second threshold, as the result of determination. However, it may be difficult for the user to change the scale trap 37 or the heat exchanger 23 soon after clogging in the secondary water circuit 28 is notified. For this reason, in some cases, it is better to keep the hot water apparatus 100 working for a while with clogged secondary water circuit 28.

In the second embodiment, when the inflow temperature is at or above the first threshold and the tank temperature is at or below the second threshold, as the result of determination, the pump 25, the heat pump 10, and the like are controlled at the same time as notifying the user of clogged secondary water circuit 28, in order to avoid wasting energy.

Figure 5:
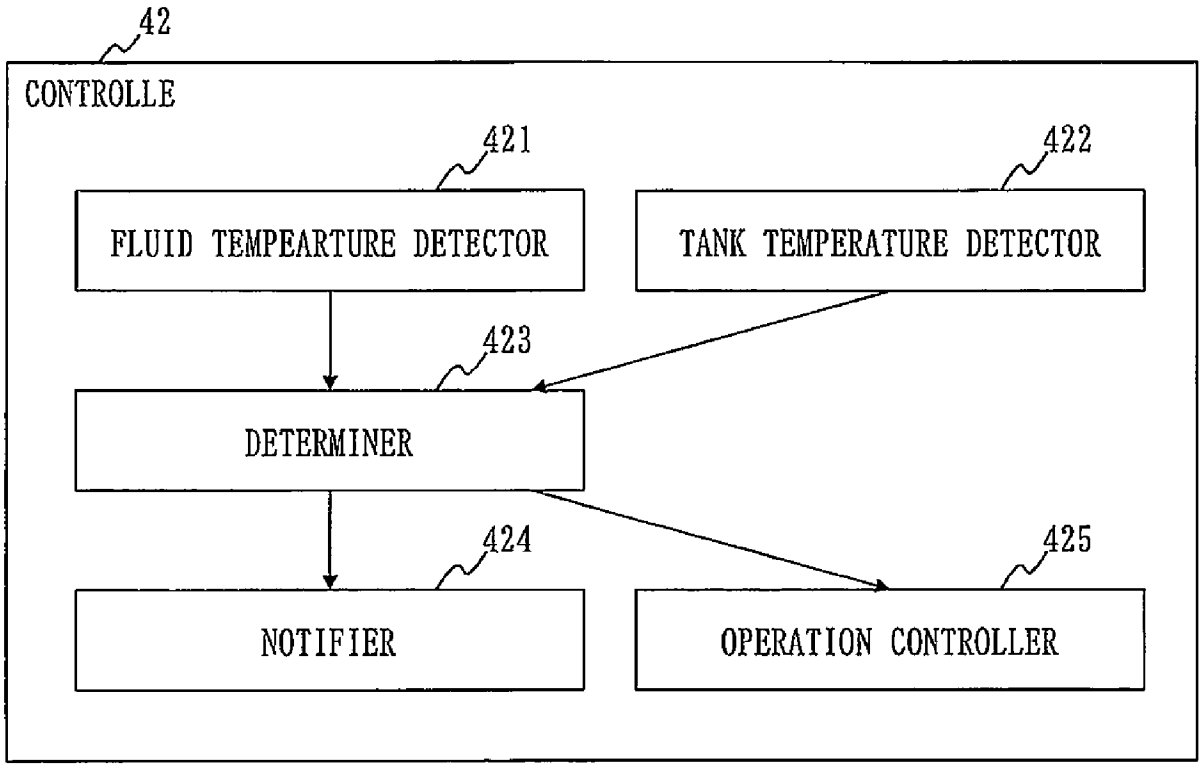
FIG. 5 illustrates a configuration of the controller 42 according to a second embodiment.

FIG. 5 illustrates a configuration of the controller 42 according to the second embodiment. Like FIG. 3, FIG. 5 shows a configuration required for detecting clogging in the secondary water circuit 28 only.

The controller 42 of the second embodiment adds an operation controller 425 to the configuration of the controller 42 shown in FIG. 3 of the first embodiment.

Figure 6:
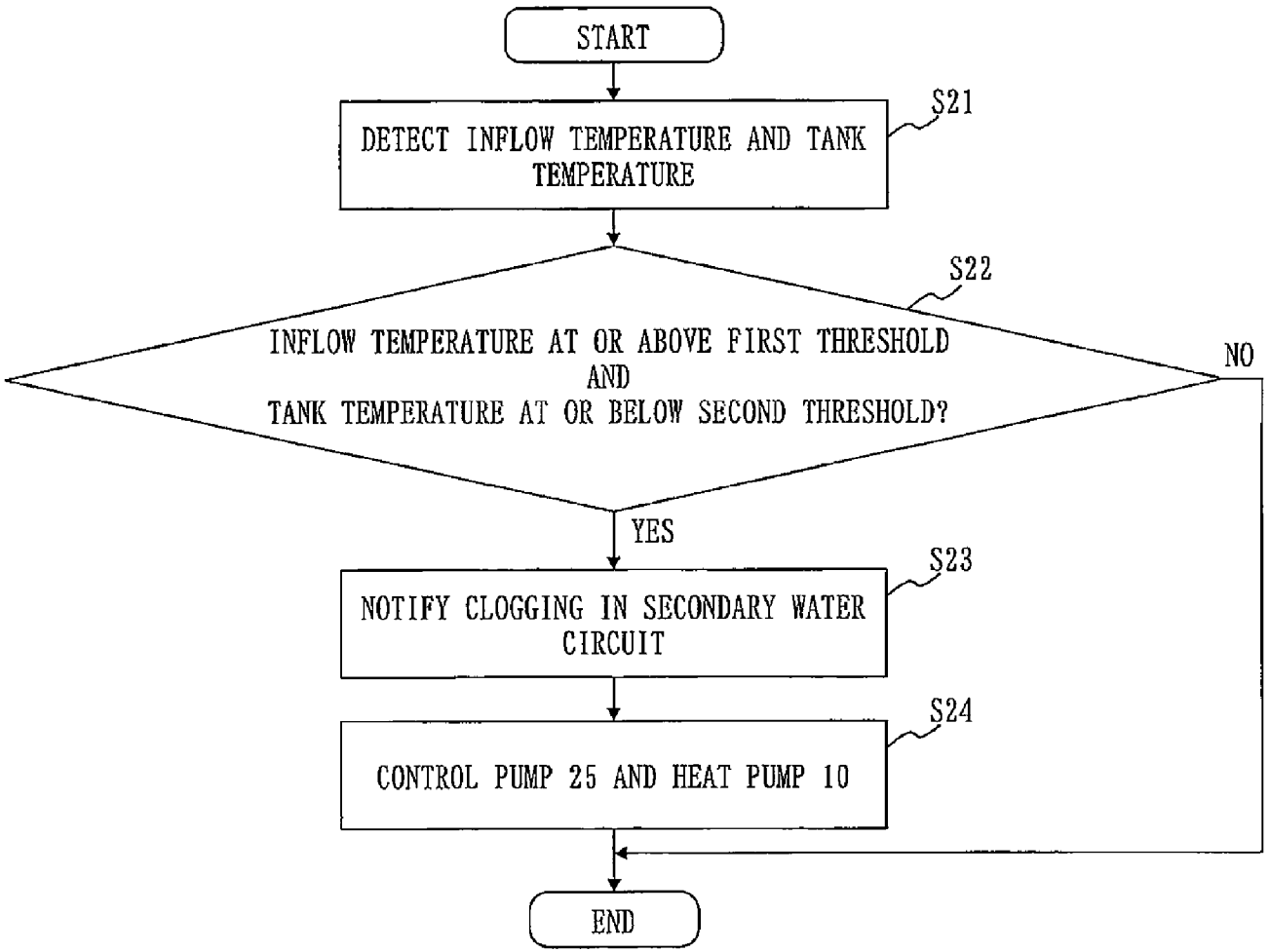
FIG. 6 is a flow chart illustrating a process of clogging detection in the secondary water circuit 28 according to the second embodiment.

FIG. 6 is a flow chart illustrating a process of detecting clogging in the secondary water circuit 28, according to the second embodiment.

Processing of S21 to S23 is the same as that of S11 to S13 in FIG. 4, and therefore will not be discussed here.

(S24: Operation Controlling Step)

When clogging in the secondary circuit 28 is notified to the user at S23, the operation controller 425 controls the pump 25 to increase the flow rate of the water circulating in the secondary water circuit 28, thereby increasing the amount of heat to be absorbed from the water circulating in the primary water circuit 27 by the water circulating in the secondary water circuit 28, at the heat exchanger 23. The operation controller 425 also controls the heat pump 10 to lower the operation frequency in order to reduce the heating capability of the heat pump 10.

This allows the hot water apparatus 100 to continue operating with certain efficiency when the secondary water circuit 28 is clogged.

However, after controlling the pump 25 and the heat pump 10 at S24, when the inflow temperature is at or above the first threshold and the tank temperature is at or below the second threshold again, as the result of determination at S22, the hot water apparatus 100 may be stopped.

Further, at S24, the flow rate of the water circulating in the secondary water circuit 28 may be gradually increased, and the operation frequency of the heat pump 10 may be gradually lowered. After increasing the flow rate up to a preset maximum, and lowering the operation frequency up to a preset minimum, if the inflow temperature is at or above the first threshold and the tank temperature is at or below the second threshold again, as the result of determination at S22, the hot water apparatus 100 may be stopped.

In the previous discussion, the control is performed at S24 after notifying the user that the secondary water circuit 28 is clogged, at 23. However, the control at S24 may be performed without the notification at S23. After the control at S24, when the inflow temperature is at or above the first threshold and the tank temperature is at or below the second threshold again, as the result of determination at S22, the clogged secondary water circuit 28 may be notified to the user.

Numerous additional modifications and variations are possible in light of the above teachings. It is therefore to be understood that, within the scope of the appended claims, the disclosure of this patent specification may be practiced otherwise than as specifically described herein.

REFERENCE SIGNS LIST

10 heat pump
11 compressor
12 expansion valve
13 heat exchanger
20 water heater
21 heat exchanger
22 heater
23 heat exchanger
24 pump
25 pump
26 tank
27 primary water circuit
28 secondary water circuit
29 three-way valve
30 junction
31 room heating circuit
32 flow sensor
33 strainer
34 pressure relief valve
35 air purge valve
36 expansion tank
37 scale trap
38 heater
39 supply port
40 feed-water inlet
41 input/output device
42 controller
421 liquid temperature detector
422 tank temperature detector
423 determiner
424 notifier
425 operation controller
50 room heater
a, b, c, d temperature sensor

The invention claimed is:

1. A hot water apparatus comprising:
a fluid circuit in which a fluid heated by a heat source circulates:
a water circuit, connected to the fluid circuit via a heat exchanger, in which water circulates;
a tank, connected to the water circuit, in which the water absorbing heat from the fluid at the heat exchanger is stored;
a fluid temperature detector that detects a fluid temperature of the fluid circulating in the fluid circuit;
a tank temperature detector that detects a tank temperature of the water stored in the tank; and
a controller, the controller is configured to:
determine whether clogging exists by determining both of: (i) whether the fluid temperature detected by the fluid temperature detector is at or above a first threshold, and (ii) whether the tank temperature detected by the tank temperature detector is at or below a second threshold,
when both of: (i) the fluid temperature detected by the fluid temperature detector is determined to be at or above the first threshold, and (ii) the tank temperature detected by the tank temperature detector is determined to be at or below the second threshold: issue, to a user, a notification indicating that the water circuit is clogged, and
when at least one of (i) the fluid temperature detected by the fluid temperature detector is determined to not be at or above the first threshold, and (ii) the tank temperature detected by the tank temperature detector is determined to not be at or below the second threshold: do not issue, to the user, the notification indicating that the water circuit is clogged.

2. The hot water apparatus of claim 1 wherein the controller is further configured to:
control, by an operation controller, the heat source to reduce heating capability, when the fluid temperature is determined to be at or above the first threshold and the tank temperature is determined to be at or below the second threshold.

3. The hot water apparatus of claim 1, wherein a pump to circulate the water is connected to the water circuit,
the controller is further configured to:
control, by an operation controller, the pump to increase a flow rate of the water circulating in the water circuit, when the fluid temperature is determined to be at or above the first threshold and the tank temperature is determined to be at or below the second threshold.

4. The hot water apparatus of claim 1, wherein the fluid temperature detector detects an inflow temperature of the fluid flowing into the heat exchanger, as the fluid temperature.

5. The hot water apparatus of claim 1, wherein the fluid temperature detector detects an outflow temperature of the fluid flowing out of the heat exchanger, as the fluid temperature.

6. The hot water apparatus of claim 1, wherein the first threshold and the second threshold are predetermined and are stored in a memory prior to determining whether clogging exists.

7. A failure notification method for a hot water apparatus, the hot water apparatus including:

a fluid circuit in which a fluid heated at a heat source circulates;

a water circuit, connected to the fluid circuit via a heat exchanger, in which water circulates;

a tank, connected to the water circuit, in which the water absorbing heat from the fluid at the heat exchanger is stored; and a controller;

the failure notification method comprising:

detecting a fluid temperature of the fluid circulating in the fluid circuit;

detecting a tank temperature of the water stored in the tank;

determining, by the controller, whether clogging exists by determining both of: (i) whether the fluid temperature detected by the fluid temperature detector is at or above a first threshold, and (ii) whether the tank temperature detected by the tank temperature detector is at or below a second threshold;

when both of: (i) the fluid temperature detected by the fluid temperature detector is determined to be at or above the first threshold, and (ii) the tank temperature detected by the tank temperature detector is determined to be at or below the second threshold: issuing, to a user, a notification indicating that the water circuit is clogged; and when at least one of (i) the fluid temperature detected by the fluid temperature detector is determined to not be at or above the first threshold, and (ii) the tank temperature detected by the tank temperature detector is determined to not be at or below the second threshold: not issuing, to the user, the notification indicating that the water circuit is clogged.

8. The failure notification method of claim 7, further comprising controlling, by an controller, the heat source to reduce heating capability, when the fluid temperature is determined to be at or above the first threshold and the tank temperature is determined to be at or below the second threshold.

9. The failure notification method of claim 7, wherein a pump to circulate the water is connected to the water circuit, further comprising:

controlling, by an operation controller, the pump to increase a flow rate of the water circulating in the water circuit, when the fluid temperature is determined to be at or above the first threshold and the tank temperature is determined to be at or below the second threshold.

10. The failure notification method of claim 7, wherein the fluid temperature detector detects an inflow temperature of the fluid flowing into the heat exchanger, as the fluid temperature.

11. The failure notification method of claim 7, wherein the fluid temperature detector detects an outflow temperature of the fluid flowing out of the heat exchanger, as the fluid temperature.

12. The failure notification method of claim 7, wherein the first threshold and the second threshold are predetermined and are stored in a memory prior to the step of determining whether clogging exists.

* * * * *